United States Patent [19]

Seki et al.

[11] Patent Number: 5,072,084

[45] Date of Patent: Dec. 10, 1991

[54] GAS CIRCUIT BREAKER

[75] Inventors: Yasuharu Seki; Osamu Koyanagi; Masanori Tsukushi, all of Hitachi, Japan

[73] Assignee: Hitachi, Ltd., Tokyo, Japan

[21] Appl. No.: 614,130

[22] Filed: Nov. 16, 1990

[30] Foreign Application Priority Data

Nov. 29, 1989 [JP] Japan ..... 1-307700

[51] Int. Cl.[5] ..... H01H 33/82

[52] U.S. Cl. ..... 200/148 A; 200/148 R

[58] Field of Search ..... 200/148 A, 148 B, 148 R

[56] References Cited

U.S. PATENT DOCUMENTS 3,839,613 10/1974 Tsubaki et al. ..... 200/148 A

FOREIGN PATENT DOCUMENTS 117758 10/1978 Japan .

OTHER PUBLICATIONS

Development of 240/300KV, 50KV, 2,000A, 4,000A, 8,000A, 2-Cycle Puffer Type $SF_6$ Gas CB, Hitachi Review 23 (1974).

"Development of High Power 2 Cycle Puffer Type Gas Circuit Breakers", IEE Conf Paper C74089-9, 1973.

*Primary Examiner*—Harold Broome

*Attorney, Agent, or Firm*—Antonelli, Terry, Stout & Kraus

[57] ABSTRACT

A gas circuit breaker includes a pair of separable contact portions, a nozzle of an electrically insulating material surrounding the contact portions to guide a flow of gas, and a buffer chamber for compressing the gas upon a separating operation of the contact portions so as to supply the gas under the guidance of the insulating nozzle. The gas from the puffer chamber is exhausted through exhaust passages passing through a hollow portion of a movable one of the contactors. The exhaust passages are formed between the puffer chamber and the movable contactor. A blocking arrangement, during initial stage of the separating operation, closes the exhaust ports of the exhaust passages and subsequently opens the exhaust ports located on a downstream side of the gas flow. The blocking arrangement, of an electrically insulating material, is divided along an axial direction of the gas circuit breaker. Electrical insulating material of the blocking arrangement is fastened by springs from the exterior of the circuit breaker to reduce unnecessary gas flow from the puffer chamber through the blocking arrangement.

7 Claims, 9 Drawing Sheets

GAS CIRCUIT BREAKER

FIELD OF THE INVENTION

The present invention relates to a gas circuit breaker which opens a high-current electric circuit, and more particularly, to a puffer type gas circuit breaker.

BACKGROUND OF THE INVENTION

Conventional puffer type gas circuit breakers are disclosed in, for example, U.S. Pat. No. 3,839,613, "Development of 240/300 kV, 50 kV 2,000 A, 4000 A, 8,000 A, 2-cycle Puffer Type $SF_6$ gas Circuit Breakers", Hitachi Review 23 (1974), pages 343 to 352, and "Development of High Power 2 Cycle Puffer Type Gas Circuit Breakers", IEEE Conf. Paper C 74 089-9. A gas circuit breaker of such type is shown in FIGS. 1 and 2.

Gas Circuit Breaker 101, as shown in FIGS. 1 and 2, is disposed in a container (not shown) filled with an arc-extinguishing gas, such as $SF_6$. The circuit breaker 101 comprises a fixed member 104, stationarily mounted with respect to the container, a fixed arc contactor 109, a main fixed contactor 110, and a movable member 112 including a main movable contactor 138 and a movable arc contactor 133 which is separable from the fixed arc contactor 109 in the axial direction of an arrow A so as to generate an arc 161 therebetween. A puffer chamber 130 is defined between a puffer cylinder 131 of the movable member 121 and a puffer piston 115 of a frame body 111 stationarily fixed with respect to the container. When the movable member 121 moves in the direction of the arrow A through an operating shaft member 124 of the movable member 121, due to a relative motion of the puffer piston 115 of the frame body 111 into the puffer chamber 130 in the direction of an arrow B, gas in the puffer chamber 130 is compressed and enters a chamber 190 defined in a a nozzle 142 made of an electrically insulating material through an opening 132 formed at one end of the puffer chamber 130. When the movable member 121 is further drawn out in the direction of the arrow A with respect to the fixed member 104 until the tip end of the fixed arc contactor 109 slips out of a small diameter throat portion 147 of the insulating nozzle 142 surrounding the tip ends of the contactors 109 and 133, the compressed gas in the chamber 190 flows through a region where the arc 161 is produced as a gas flow 162 passing through the throat portion 147 so as to cool the gaseous plasma of the arc 161. In this case, openings 139 of an exhaust passage 140 defined inside a shaft 191 of the movable member 121 are communicated with openings 120 formed in a cylindrical shaft portion 192 of the puffer piston 115, so that a gas flow 163 is formed simultaneously which is directed to flow from the chamber 190 and pass through the axial exhaust passage 140 and the openings 139 and 120. This gas flow 163 serves to cool the gaseous plasma of the arc 161. Consequently, double gas flows 162 and 163 effect cooling of the arc 161 to extinguish the arc 161, thereby interrupting the current between the fixed arc contactor 109 and the movable arc contactor 133.

However, in this kind of conventional gas circuit breaker 101, a larger force is required for operation of separating the movable contactor 133 in the direction of the arrow A. More particularly, since it is indispensable to compress the gas for generating an arc-extinguishing gas flow, this operating force could not be substantially reduced. Further, the diameter of the exhaust passage 140 can not be very large to avoid an increase in the diameter of the breaker although the exhaust passage 140 through the shaft 191 is long. Consequently, the flow resistance through the exhaust passage 140 is increased to hinder the gas from flowing sufficiently, resulting in a difficulty in extinguishing the arc 161.

Additionally in, for example, Japanese Patent Laid-Open Publication No. 53-117758 a thermal puffer type gas circuit breaker comprises an expansion or arc-extinguishing chamber for compressing gas using heat of the arc and extinguishes an arc by blowing or puffing the gas compressed in the expansion chamber against the arc (i.e. by flowing the gas along the arc to cool the arc). However, in this thermal puffer type gas circuit breaker as well, although the double flow method is adopted by providing in the exhaust passage a pressure-responsive valve utilizing spring force with the intention of interrupting a large electric current as well, it is hard to stably extinguish the arc for a long time period over a wide range of electric current due to presence of the pressure-responsive valve or the like, and a lower performance for interrupting a small electric current is experienced due to the presence of the pressure-responsive valve.

SUMMARY OF THE INVENTION

An object of the present invention is to provide a gas circuit breaker having an improved large current breaking performance which is capable of reducing the flow resistance to a gas flow used for arc extinguishment in cooperation with an arc-extinguishing gas flow passing through a throat portion of an electrically insulating nozzle, reducing a force required for operation.

According to the present invention, comprises a pair of separable contact portions a nozzle of an electrically insulating material surrounding the contact portions so as to guide a flow of gas, and a puffer chamber means for compressing the gas therein in conjunction with a separating operation of the contact portion so as to supply the gas under a guidance of the insulating nozzle, with the gas from the puffer chamber means being exhausted through at least one exhaust passage passing through a hollow portion of the one of the contactors located within the insulating nozzle. The at least one exhaust passage is formed between the puffer chamber and the one of the contactors. A blocking means serves to close during an initial stage of the separating operation and subsequently open exhaust ports formed at end of the at least one exhaust passage located on a downstream side of the gas flow dividing an exhaust gas guide of a frame of the gas circuit breaker into a number of elements along the axial direction of the gas circuit breaker. The exhaust gas guide is fastened from outside thereof by a spring and/or is electrically insulated from a cylindrical portion connected to the exhaust gas guide.

In the gas circuit breaker according to the present invention, the puffer chamber means serving to compress the gas to be formed as an arc-extinguishing flow in conjunction with the separating or opening operation extends in the axial direction of a driving shaft connected with a movable element, and the exhaust passages through which the gas acting on an arc is exhausted are formed between the puffer chamber means and the movable element. Therefore, a length of the gas flow path in the exhaust passages can be significantly reduced as compared with the conventional puffer type gas circuit breaker, thereby making it possible to reduce the flow resistance in the exhaust passages.

Further, in the gas circuit breaker according to the present invention, since the blocking means serves to close the exhaust ports of the exhaust passages formed on the downstream of the gas flow at least during the initial stage of a current breaking operation, it is possible not only to suppress the formation of an unnecessary gas flow passing through the exhaust ports in the initial stage of the current breaking operation but also to generate a gas flow passing through a throat portion of the insulating nozzle and the gas flow passing through the exhaust passage because the blocking means permits the exhaust ports to be subsequently opened. It is therefore possible to further improve the large current breaking performance due to gas flows in two directions or double gas flows.

DETAILED DESCRIPTION OF THE PREFERRED EMBODIMENTS

Figure 3:
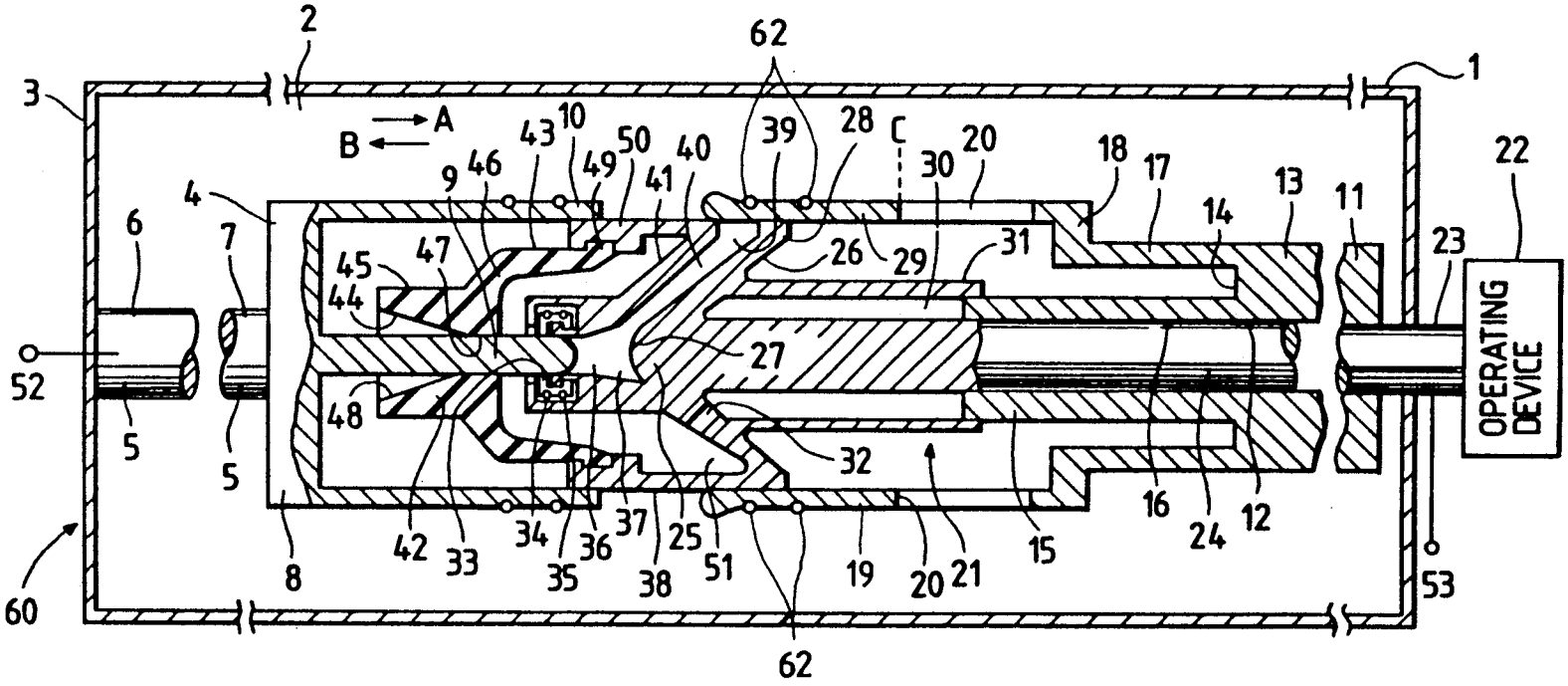
FIG. 3 is a sectional view of a gas circuit breaker according to an embodiment of the present invention in a closed state.
Figure 4:
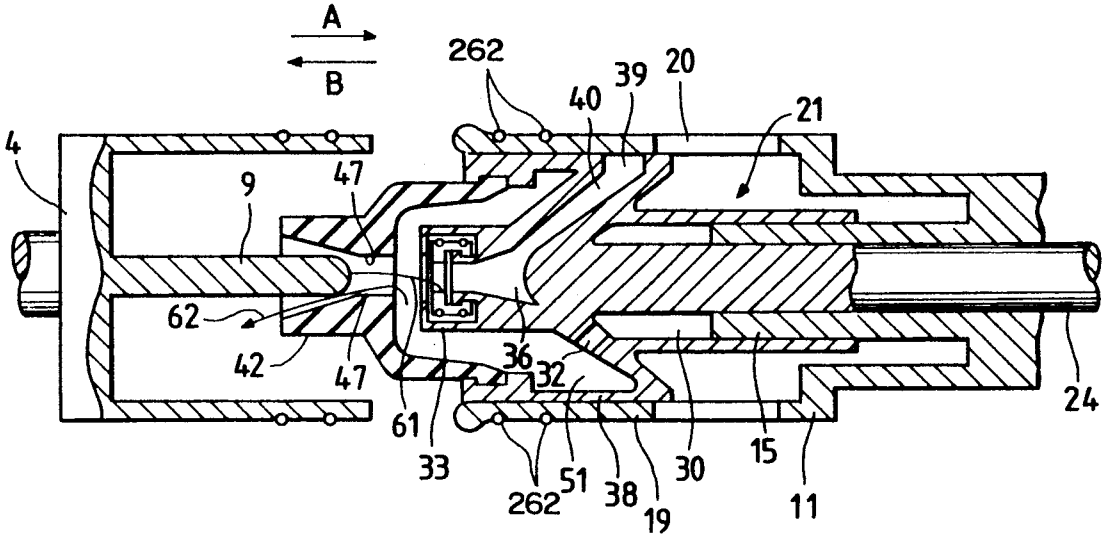
FIGS. 4 and 5 are sectional views of the gas circuit breaker of FIG. 3 in an initial stage and an intermediate stage of a breaking operation, respectively.
Figure 5:
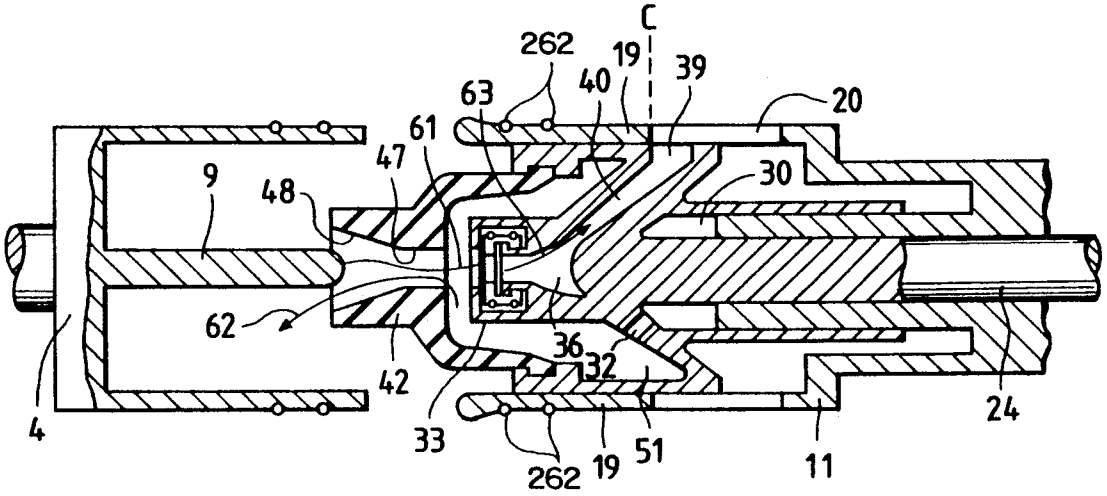

Referring now to the drawings wherein like reference numerals are used throughout the various views to designate like parts and, more particularly, to FIGS. 3-5, according to there figures, a close container 1 has an interior 2 filled with an arc-extinguishing gas such as, for example $SF_6$. A shaft portion 5 of a fixed element body 4 made of an electrically conductive material is fixed at one end 6 thereof to an end wall 3 of the closed container 1. The fixed element body 4 includes a central arc contactor portion 9 extending in an axial direction A from the center of a flange portion 8 formed at the other end 7 of the shaft portion 5, and a hollow cylindrical main fixed element portion 10 extending from the circumferential edge of the flange portion 8 in the axial direction A.

A frame body is stationarily fixed with respect to the closed container 1 like the fixed element body 4, with the frame body 11 having a cylindrical base portion 13 of a large thickness and a central hole 12. A hollow cylindrical puffer piston portion 15 extends from a radially inner edge portion of an end portion 14 of the base portion 13 in an axial direction B. The cylindrical piston portion 15 has a hole 16 coaxial with and having the same diameter as that of the central hole 12. A medium diameter cylindrical portion 17 extends from a radially outer edge portion of the end portion 14 of the base portion 13 in the axial direction B, a flange portion 18 extends radially outwardly from the end 14 of the cylindrical portion 17, and a large diameter exhaust gas guide 19 of extends from the outer edge of the flange portion 18 in the axial direction B. A plurality of equidistantly spaced openings 20 are formed in the large-diameter exhaust gas guide 19 serving as a block means, at an axially predetermined position C thereof.

Figure 1:
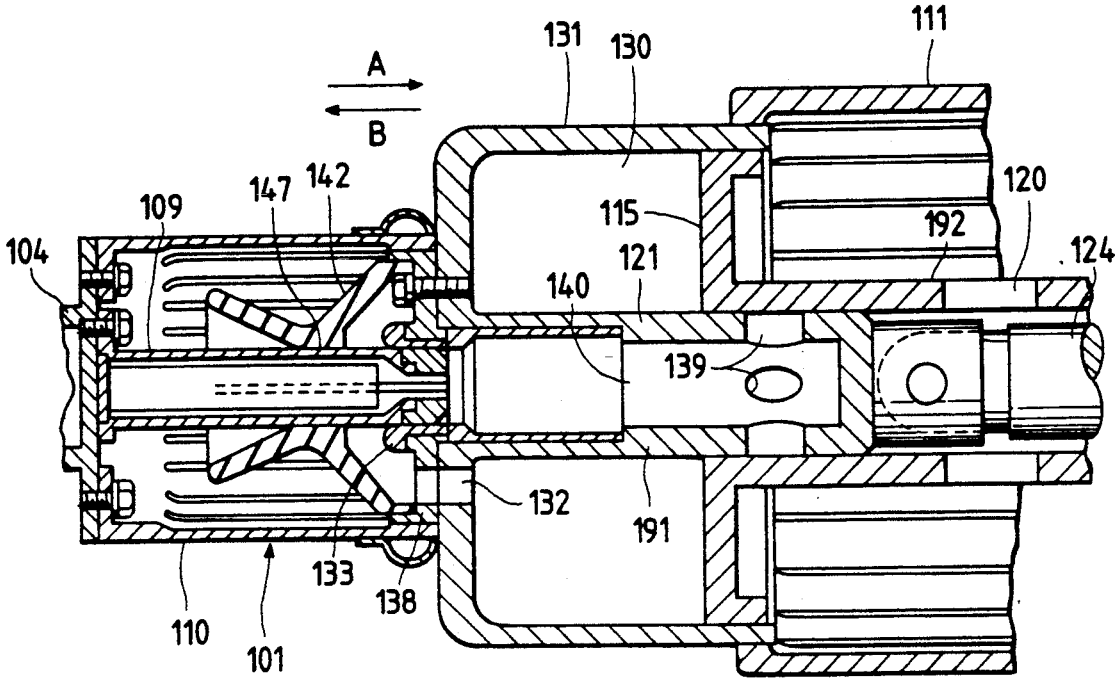
FIG. 1 PRIOR ART
FIG. 1 is a sectional view of a conventional puffer type gas circuit breaker, in a closed position.

A movable part 21 of an electrically conductive material, is movable in the axial directions A and B with respect to the fixed element body 4. The movable part 21 has an operating shaft portion 24 which is fixed at one end 23 thereof to an operating device or actuator 22 and extends from the end 23 in the axial direction B while slidably passing through the holes 12, 16 of the frame body 11. The shaft portion 24 is formed at the other end 25 thereof with a hollow conical portion 26 extending radially outwardly from the end 25 in the direction B. The conical portion 26 is curved smoothly at a tip end 27 thereof for permitting gas to flow smoothly. An outer edge portion 28 of the conical portion 26 is bent radially outwardly and brought into gastight contact with an inner peripheral surface 29 of the large-diameter exhaust gas guide 19 of the frame body 11 in the state of FIG. 1. A cylindrical portion 31, serving as a puffer cylinder, is formed to extend from an intermediate portion of the inside surface of the conical portion 26 in the axial direction A and fitted around the cylindrical piston portion 15 of the frame body 11 so as to define a cylindrical puffer chamber 30 in cooperation with the outer peripheral surface of the shaft portion 24. The conical portion 26 is formed with a hole 32 which opens into the chamber 30 so that, when the movable part 21 is moved in the direction A with respect to the frame body 11, the compressed gas flows out of the chamber 30 with the insertion of the piston portion 15 into the chamber 30 in the direction B.

Further, a hollow cylindrical movable arc contactor portion 33 extends from the end of the shaft portion 24 in the axial direction B. The cylindrical movable contactor portion 33 is fitted around the central arc contactor portion 9 in the closed or inoperative state shown in FIG. 3. When the part 21 is moved in the direction A with respect to the fixed element body 4, electric contact between the movable part 21 and the fixed element body 4 is released. The movable contactor portion 33 is formed in the outer peripheral surface thereof with concave portions 34 at a position close to the tip end, and ring springs 35 are provided in the concave portions 34. A space 36, defined inside the movable contactor portion 33, conically diverges at 37 near to the curved end 27 of the shaft portion 24.

A large diameter cylinder 38, the tip end of which serves as a main movable element, extends in the axial direction B from the outer edge portion 28 of the conical portion 26. The cylinder 38 gastightly fitted in the exhaust gas guide 19 of the frame body 11. The cylinder 38 is formed with a plurality of circumferentially equidistantly spaced openings 39 at the position thereof in the vicinity of the outer edge portion 28. A passage 40, extending radially outwardly from the conical chamber 37 in the movable contactor portion 33, is formed between each of the openings 39 and the conical chamber 37. These passages 40 are defined by the conical portion 26 and a plurality of obliquely extending internal wall portions 41, so that each passage 40 is inclined with respect to the radial direction so as to smooth the flow of gas from the chamber 36. The passages 40 serve as exhaust passages, and the openings 39 serve as exhaust ports.

A nozzle 42, of an electrically insulating material, comprises a hollow large diameter cylindrical portion 43, a small diameter nozzle main body portion 45 having a nozzle hole 44 and an intermediate portion 46 for connecting the cylindrical portion 43 with the main body portion 45. The nozzle hole 44 includes a cylindrical hole portion 47, as a throat portion, into which the central fixed arc contactor portion 9 is gastightly fitted, and a conical hole portion 48 extending outwardly therefrom. One end 49 of the portion 43 of the nozzle 42 is brought into gastight engagement with the inside groove formed in an expanded end portion 50 of the cylinder 38 of the movable part 21, so that the nozzle 42 cooperates with the cylinder 38, the internal wall portions 41, the conical portion 26 and the movable contactor portion 33 to define an expansion chamber 51 in which the gas heated and compressed by the arc is stored or accumulated.

In addition, the fixed element body 4 and the movable part 21 are arranged in series in an AC line of 50 to 60 Hz, for example, through terminals 52 and 53. In the inoperative or closed state of a circuit breaker 60, an electric current flows between the terminals 52 and 53 through electrical connections between the central fixed element portion 9 and the movable contactor portion 33 which are in contact with each other and between the main fixed element portion 10 and the cylinder 38 of the movable part 21 which are in contact with each other as shown in FIG. 3.

In breaking the electrical connection between the terminals 52 and 53, the circuit breaker 60 is operated in the following manner.

First, upon receipt of an instruction or signal to interrupt the current, the operating device 22 is actuated to cause the shaft portion 24 to move in the direction A with respect to the fixed element body 4 and the frame body 11. This movement first breaks the electrical connection between the main fixed element portion 10 and cylinder 38, but the central fixed arc contactor portion 9 and the movable contactor portion 33 are maintained in contact with each other. The movement of the shaft portion 24 in the direction A causes the cylindrical piston portion 15 of the frame body 11 to be moved into the puffer chamber 30 in the direction B, so that the pressure of gas in the puffer chamber 30 and the expansion chamber 51 communicated therewith is increased.

Further movement of the shaft portion 24 in the direction A causes the central fixed arc contactor portion 9 to slip out of the movable contactor portion 33, thus starting a separation of the movable contactor portion 33 from the central fixed arc contactor portion 9. As a result, the arc discharge 61 starts to take place between the central fixed arc contactor portion 9 and the movable contactor portion 33. During an initial stage of such a breaking operation, the central fixed arc contactor portion 9 still closes the hole 47 of the nozzle 42 so that relative insertion of the cylindrical piston portion 15 of the frame body 11 into the puffer chamber 30 in the direction B causes the increase of the pressure of the gas not only in the puffer chamber 30 and the expansion chamber 52 but also in the chamber 36 defined inside the movable contactor portion 33 in communication with the expansion chamber 51 and the exhaust passages 40 the openings 39 of which are closed by the cylinder 38 serving as the a blocking means. In addition, the arc 61 produced between the central fixed element portion 9 and the movable contactor portion 33 causes the gas in the expansion chamber 51 and the chamber 36 inside the movable contactor portion 33 to be heated, resulting in the increase of the pressure of the gas in the expansion chamber 51 and the like.

Upon an interruption of a relatively small electric current, since the arc 61 heats the gas to a relatively low degree, the gas is not greatly heated nor compressed by the arc 61 but the gas in the chambers 30, 51, 36 and 40 has been compressed to reach a certain level of pressure due to insertion of the piston 15 into the puffer chamber 30. Consequently, as shown in FIG. 4, when a further movement of the shaft portion 24 in the direction A causes the central fixed element portion 9 to slip out of the throat-like cylindrical hole 47 of the nozzle 42, the gaseous plasma of the arc discharge 61 is cooled by the gas flow 62 flowing out of the expansion chamber 51 through the throat-like hole portion 47, that is, by puffering of the gas flow 62, resulting the electric resistance in this gaseous region increasing to extinguish the arc discharge 61 at a timing close to the zero-cross point of an instantaneous magnitude of AC electric current where the arc 61 is thin, thereby breaking the electrical connection between the central fixed arc contactor portion 9 and the movable contactor portion 33.

In the circuit breaker 60, since no exhaust passage is formed in the shaft portion 24 unlike the conventional circuit breakers, the shaft portion 24 can be of a relatively small diameter. In addition, only a small amount of gas is required for puffering with a small current, so that the diameter of the puffer chamber 30 formed around the relatively small diameter shaft portion 24 relatively small as well, resulting in a reduction in the cross-sectional area of the puffer chamber 30 and, therefore, the operating force exerted by the operating device 22 can be reduced.

On the other hand, when a large electric current is to be interrupted, the gas continues to be heated and compressed by the arc 61 until the central fixed arc contactor portion 9 slips out of the throat hole portion 47 of the nozzle 42 as shown in FIG. 4; however, it is impossible to extinguish the arc 61 by cooling it using only puffering of the gas flow 62 passing through the throat hole portion 47 of the nozzle 42. However, when the shaft portion 24 is further moved in the direction A to bring about the breaking operation in its intermediate stage shown in FIG. 5, the central fixed arc contactor portion 9 comes out of the conical hole 48 of the nozzle 42 and the exhaust ports 39 of the exhaust passages 40 are moved to the position C so as to be perfectly communicated with the openings 20 of the exhaust gas guide 19 as the blocking means. Consequently, the gaseous plasma of the arc discharge 61 is cooled by two gas flows, that is, double flows including the gas flow 62 flowing through the throat-like hole portion 47 from the puffer chamber 30 and the expansion chamber 51 the pressure in which has been increased and the gas flow 63 flowing from the expansion chamber 51 through the chamber 36, the exhaust passages 40 and the openings 39, resulting in an increase in the electric resistance in this arc region to extinguish the arc 61 at a timing close to the zero-cross point of the instantaneous magnitude of AC electric current, thus breaking the electrical connection between the central arc contactor element portion 9 and the movable contactor portion 33. The time period from receipt of breaking instruction or signal to extinguishment of the arc 61 is substantially equal to the time period during which the instantaneous AC current value becomes zero twice (about 1/50 to 1/60 sec., for example).

In the circuit breaker 60, since the exhaust passages 40 extend radially outwardly between the movable contactor portion 33 and the puffer chamber 30, unlike the conventional circuit breakers, the length of the exhaust passage 40 can be reduced independently of the length of the puffer chamber 30. Consequently, the flow resistance of the exhaust passage 40 to the gas flow 63 discharged through the exhaust passages 40 and the openings 39 can be reduced so that the gas flow 63 can be made large sufficiently at the timing shown in FIG. 5, thereby assuring more reliably the extinguishment of the arc 61 using the gas flow 63 in cooperation with the gas flow 62.

Figure 9:
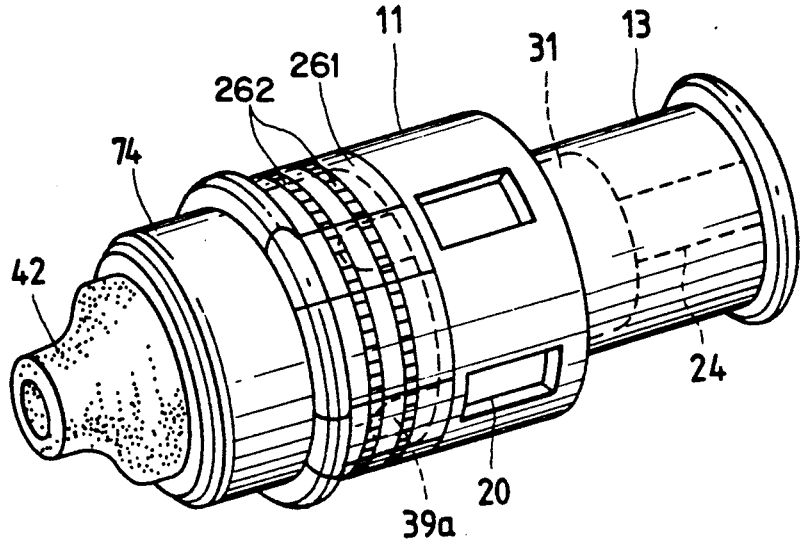
FIG. 9 is a perspective view of the whole movable part and the exhaust gas guide of FIGS. 3 and 6.

The exhaust gas guide 19 is made of a metal, for example, iron, or an electrically insulating material such as PTFE (polyterafluorethylene) which is a heat-resisting and antifriction lubricating material. The exhaust gas guide 19 is divided along the axial direction of the shaft portion 24 and fastened by two springs 262 from the outside of the exhaust gas guide 19 as shown in FIG. 9 for a gap between the exhaust gas guide 19 and the cylinder 38.

In FIGS. 3 to 5, the movable part 21 is illustrated as being a single body in practice except for the insulating nozzle 42. However, the movable part 21 may be an assembly of parts suitable to manufacture and subsequently assemble. More particularly, as shown in FIGS. 6–12, a movable part assembly **21*a* comprises four electrically conductive members 71, 72, 73 and 74 and an insulating nozzle 42, with the first member 71 mainly forms a shaft portion 24 and a movable contactor portion 33. The movable contactor portion 33 of the first member 71 is formed circumferentially equidistantly with a plurality of, three or four, notched portions 40*a* which partially form exhaust passages 40. The second member 72 mainly forms an outer peripheral wall or puffer cylinder 31 of a puffer chamber 30 and conical wall portion 26 which partially forms the exhaust passages 40 and expansion chambers 51. The wall portion 26 is formed, in parts thereof which define the expansion chambers 51, with holes circumferentially equidistantly serving as passages 32 for communicating the puffer chamber 30 with the expansion chambers 51. The expansion chambers 51, the holes 32 and the exhaust passages 40 are equal in number to each other. Further, in a part of this example (FIGS. 7 to 11), a radially outer end portion 28 of the conical wall portion 26 does not extend perpendicularly but obliquely to the axial direction. The third member 73 includes an umbrella-shaped member which mainly serves to partially form the peripheral walls of the exhaust passages 40. Convex portions of the bevel member constitute wall portions 41 of the exhaust passages 40, and concave portions thereof are closely put on the conical portion 26 of the second member 72 to constitute the wall portions of the expansion chambers 51. The convex portions constituting the wall portion 41 are formed at circumferential positions where they exactly coincide with the notched portions 40*a* of the first member 71. The fourth member 74 serves to airtightly support the insulating nozzle 42 by a portion of the inner peripheral wall of a cylinder 38 serving as the main movable element as well as to mainly form the expansion chambers 51. The fourth member 74 is put on the conical portion 26 of the second member 72 so as to exactly cover the movable contactor portion 33 of the first member 71 and the third member 73. The fourth member 74 is formed with notched portions 39*a* which correspond to the exhaust ports 39 at circumferential positions corresponding to the exhaust passages 40**.

Figure 6:
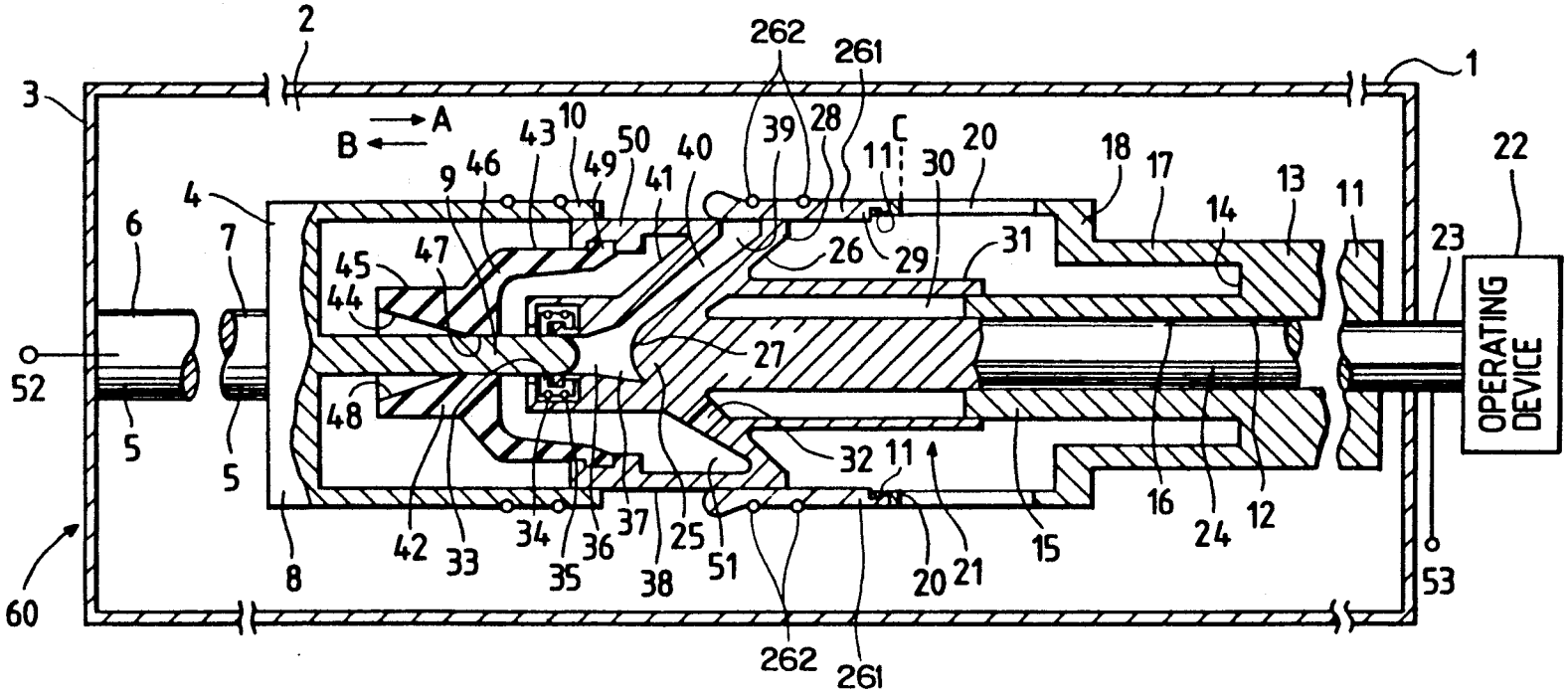
FIG. 6 is a sectional view of a gas circuit breaker according to another embodiment of the present invention.
Figure 7:
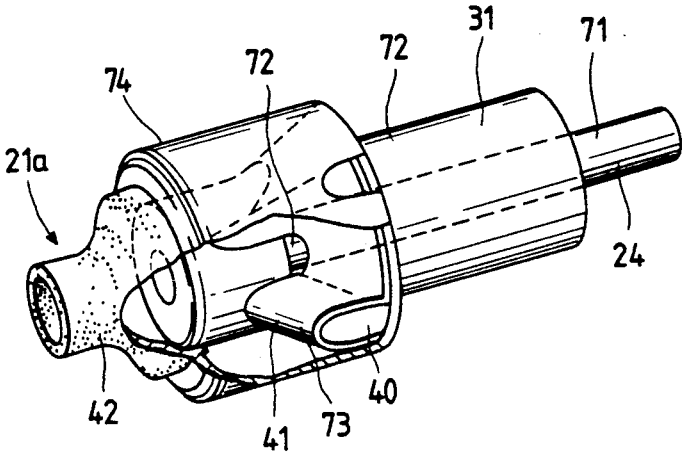
FIG. 7 is a partially broken perspective view of a movable part of the gas circuit breaker of FIG. 3.

Referring to FIG. 6, the exhaust gas guide 261 is made of the electrically insulating material such as PTFE. The cylindrical portion 17 of the frame 11 connected to the exhaust gas guide 261 is made of the metal such as iron and has the openings 20. The inner diameter of the exhaust gas guide 261 is larger than that of the frame 11 connected to the exhaust gas guide for preventing current flow from the exhaust gas guide 261 to the cylindrical portion 17 which causes damage to the contacted surface thereof while the fixed contactor 9 and the movable contactor 33 are contacted.

Figure 10:
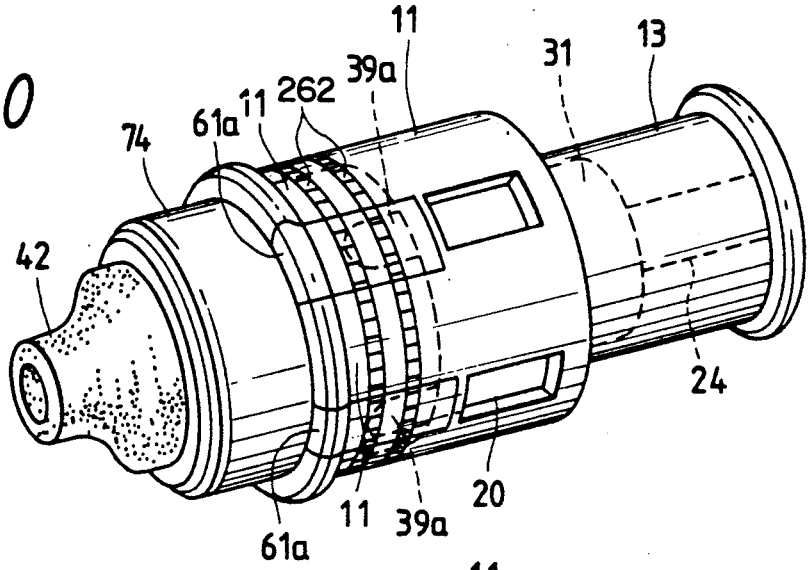
FIG. 10 is a perspective view of the entire movable part and the exhaust gas guide of another embodiment of the present invention.

FIG. 10 shows an embodiment in which only the specific exhaust gas guides **61*a* covering the exhaust ports 39*a* are made of the electrical insulating material such as PTFE and the frame 11** are made of the metal such as iron.

Figure 11:
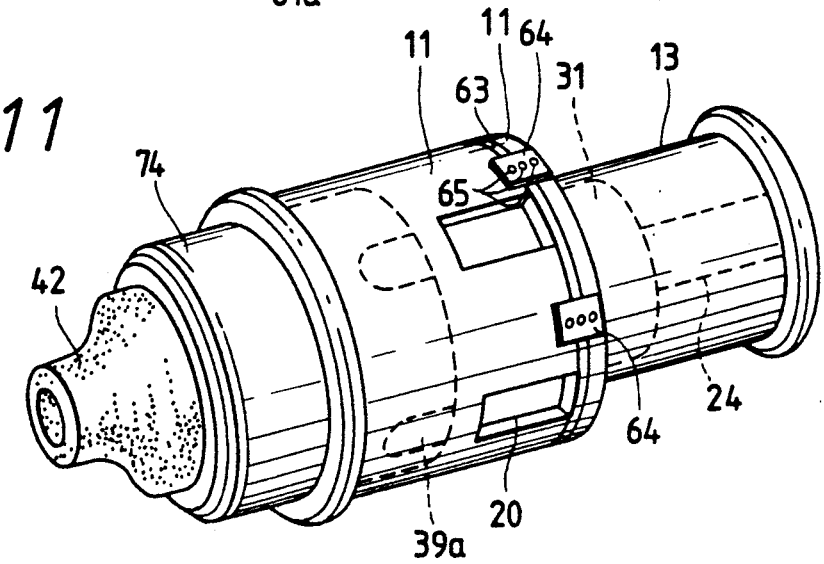
FIG. 11 is a perspective view of the entire movable part and the exhaust gas guide of FIG. 12.
Figure 12:
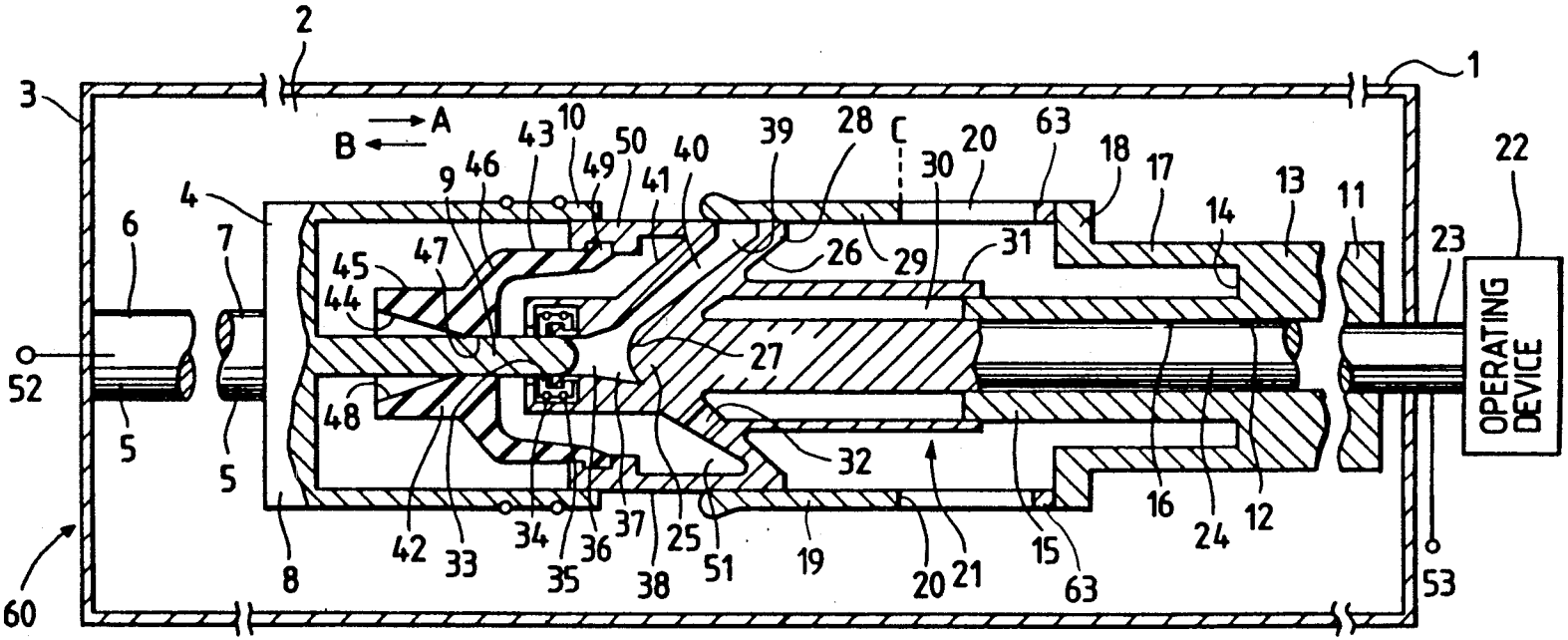
FIG. 12 is a sectional view of a gas circuit breaker of a further embodiment of the present invention.

Referring to FIG. 12, the exhaust gas guide 19 is made of a metal such as iron as well as the cylindrical portion 17. A electrically insulating material 63 is inserted between the exhaust gas guide 19 and the cylindrical portion 17. The electrically insulating material 63, the exhaust gas guide 19 and the flange 18 are covered by electrically insulating materials 64 from the outside thereof and fixed by bolts 65 as shown in FIG. 11.

Figure 8:
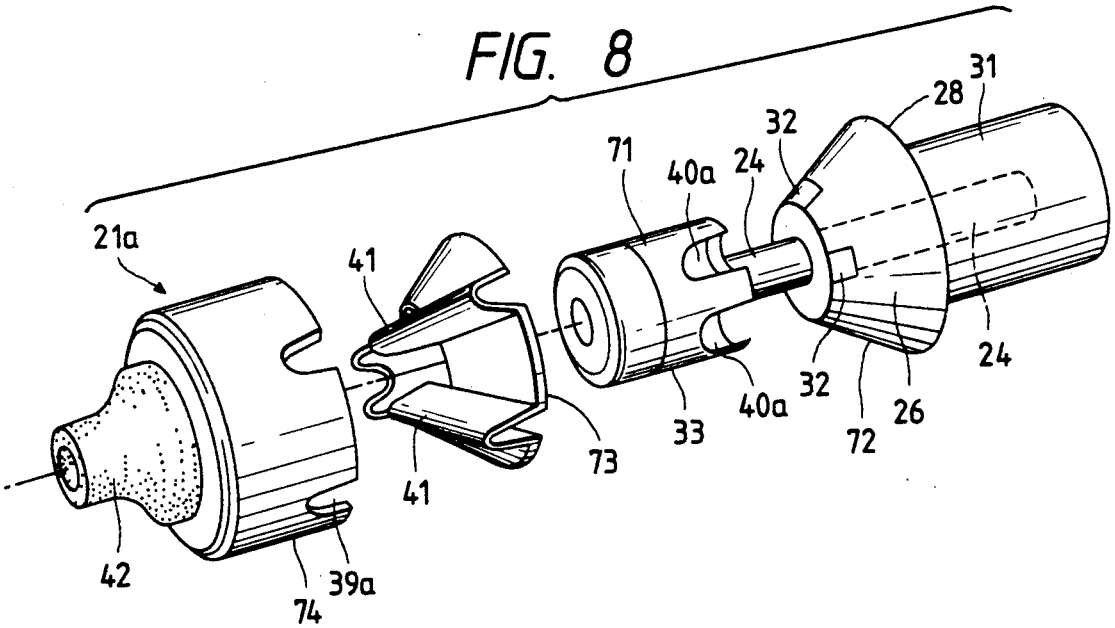
FIG. 8 is an exploded perspective view of the movable part of FIG. 7.
Figure 13:
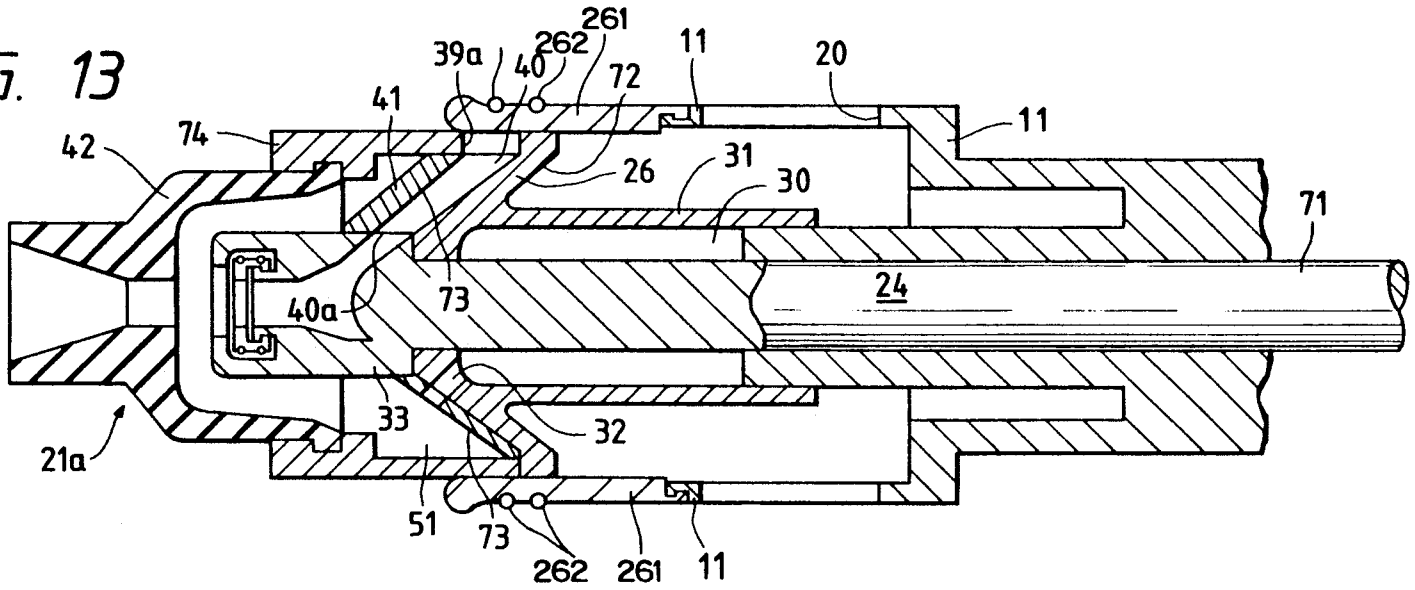
FIG. 13 is a sectional view of a gas circuit breaker according to a still further embodiment of the present invention.

FIG. 13 shows a preferred embodiment in which the movable portion 21 is constituted by the assembly **21*a* shown in FIG. 8**.

Figure 14:
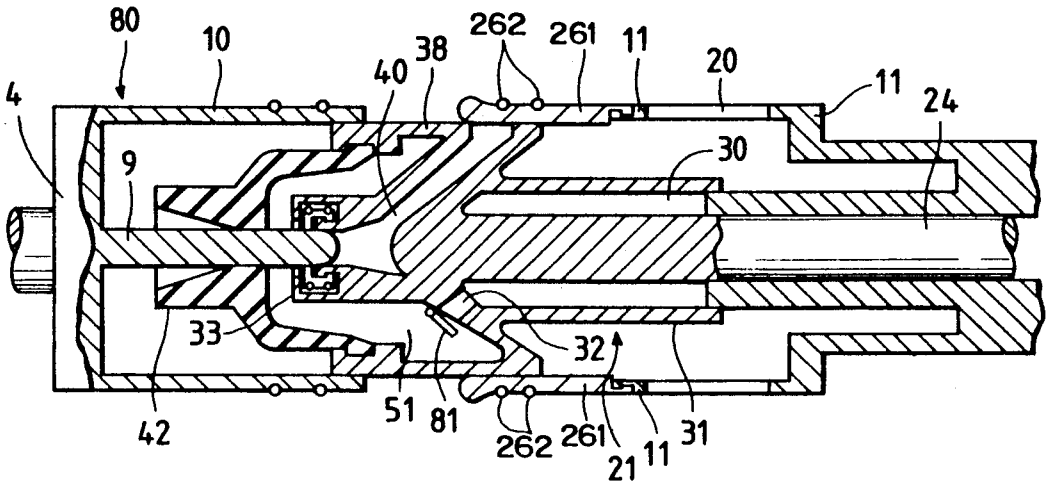
FIG. 14 is a sectional view of a gas circuit breaker according to yet another embodiment of the present invention.

In the gas circuit breaker 80 shown in FIG. 14, the passages 32 for communicating the puffer chamber 30 with the expansion chamber 51 is provided with a check valve 81. The check valve 81 permits the gas to flow from the puffer chamber 30 into the expansion chamber 51 but prevents the gas from flowing from the expansion chamber 51 into the puffer chamber 30.

Consequently, in interrupting the electric current, when the gas pressure in the expansion chamber 51 is higher than that in the puffer chamber 30, since the check valve 81 is closed the compressed gas in the expansion chamber 51 is first used for puffering against the arc 61. Namely, the compressed gas in the expansion chamber 51 serves as the source of cooling flows 62 and 63 along the arc 61. This puffering of the cooling flows 62 and 63 causes the gas pressure in the expansion chamber 51 to become lower than the gas pressure in the buffer chamber 30. Then the check valve 81 is opened to allow the gas-puffering cooling flows 62 and 63 to arise from the puffer chamber 30. Accordingly, the duration of gas puffering for extinguishing the arc 61 can be made longer as compared with the gas circuit breaker 60 with no check valve 81, thereby assuring the extinguishing of the arc 61 more reliably. In addition, as the pressure in the puffer chamber 30 is not increased even when the pressure in the expansion chamber 51 is increased upon interrupting large electric current, the reaction force against operation of the shaft 24 can be made smaller.

Figure 15:
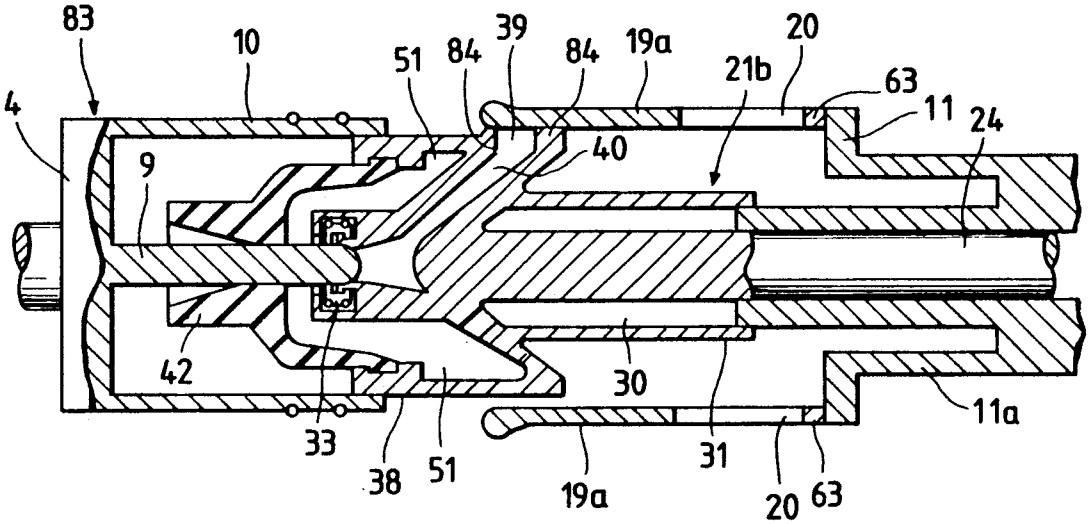
FIG. 15 is a sectional view of a gas circuit breaker according to another embodiment of the present invention.

In the gas circuit breaker 83 shown in FIG. 15, a peripheral wall 84 of the exhaust port 39 of each of the exhaust passages 40 is formed by an annular projection which projects in the radial direction of the shaft 24. Namely, the annular projection 84 projecting in the radial direction of the shaft 24 is formed around each of the exhaust ports 39 in the large-diameter cylinder 38 of a movable part **21*b* corresponding to the movable part 21 of FIG. 3. This increases the radius of a large-diameter cylindrical cylinder 19*a* of a frame body 11*a*, corresponding to the large-diameter cylinder 19 of the frame body 11 of FIG. 3, by an amount corresponding to the radial height of the projection 84. The large-diameter cylinder 19*a*, therefore, is brought into a sliding contact only with the projecting ends of the annular projections 84 formed circumferentially equidistantly on the movable part 21*b*, thus opening and closing the exhaust ports 39. As a result the sliding contact area of the movable part 21*b* can be made smaller than that of the movable parts 21, thereby making it possible to reduce the sliding resistance of the movable part 21*b***.

Figure 2:
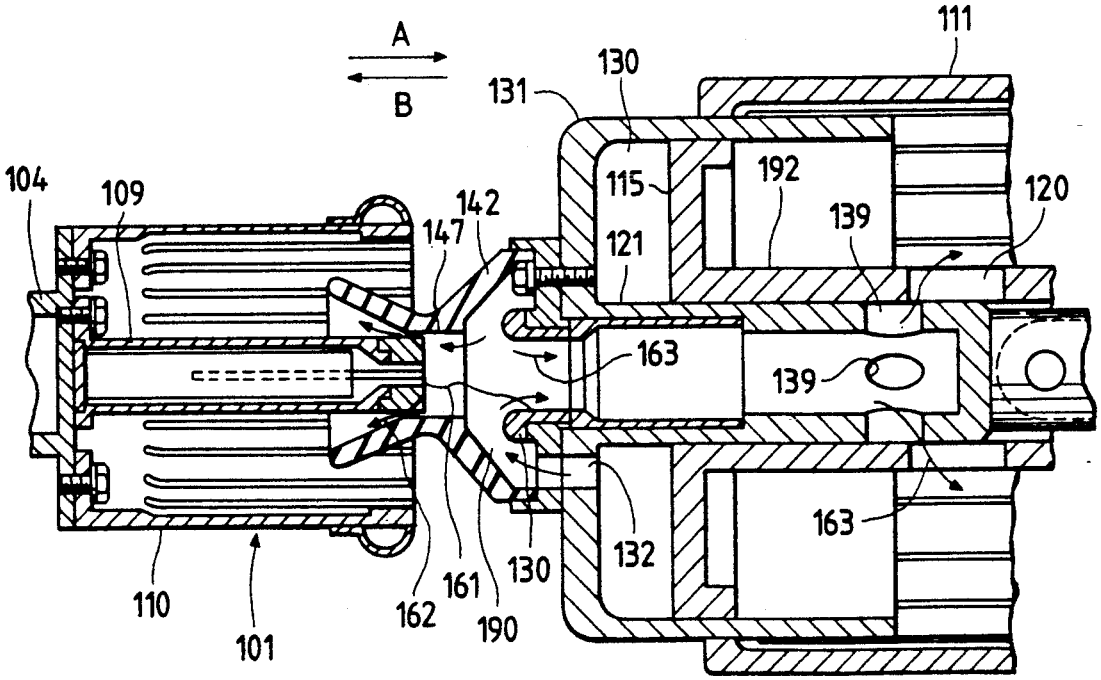
FIG. 2 PRIOR ART
FIG. 2 is a sectional view of the gas circuit breaker of FIG. 1 is an open or operable position.
Figure 16:
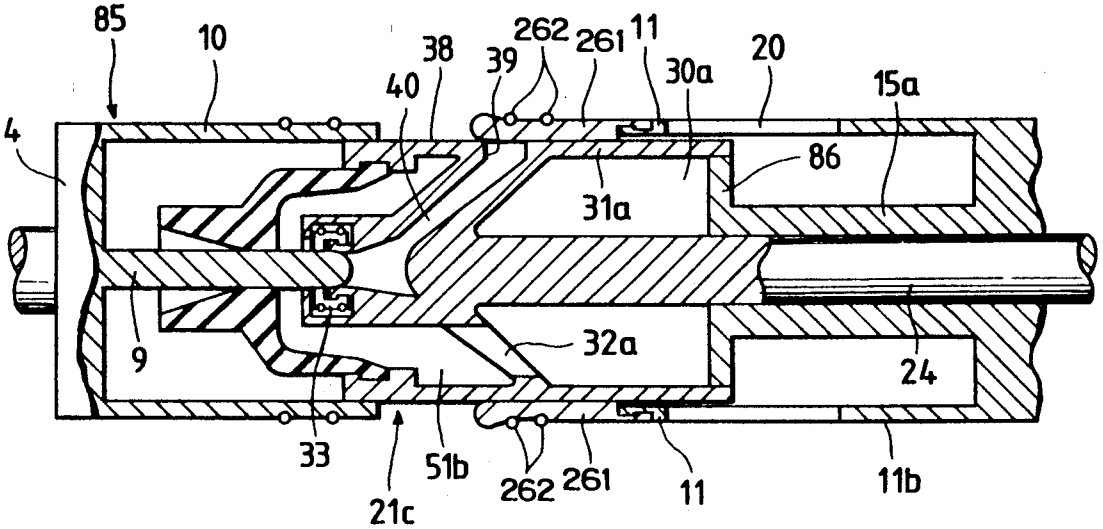
FIG. 16 is a sectional view of a gas circuit breaker according to a further embodiment of the present invention.

In the gas circuit breaker 85 shown in FIG. 16, a cylindrical portion **31*a* of a movable element 21*c*, corresponding to the cylindrical portion 31 of the movable part 21 of FIG. 2, has a large diameter so as to be brought into sliding contact with the large-diameter cylinder 19 of the frame body 11. Therefore, a puffer chamber 30*a* has a large diameter as well, and a piston main body portion 86 of the frame body 11*b* which is inserted into the puffer chamber 30*a* is formed at tip end of a hollow shaft piston portion 15*a*. In addition, a hole 32*a* formed in the conical wall 26 defining the end portion of the puffer chamber 30*a* has a large diameter as well. The embodiment of FIG. 16** simpler in construction than the other embodiments mentioned above.

In addition, the main fixed element 10 can be eliminated. In this case, the cylindrical portion of the movable member 21 does not function as the main movable element but functions as the wall for defining the expansion chamber.

What we claim is:

1. A gas circuit breaker comprising:

an arc extinguishing gas;

a fixed contactor and a movable contactor separable from each other;

a nozzle of an electrically insulating material surrounding said contactors so as to guide a flow of the gas;

a cylinder forming a unitary body together with said movable contactor and said insulating nozzle, said cylinder having an operating shaft and forming a puffer chamber for compressing the gas therein upon a separation of said contactor;

a frame body comprising an exhaust gas guide gas-tightly fitted to said cylinder and having an opening therein, a cylindrical portion connected to the exhaust gas guide extending in an opposite direction to said fixed contactor along an axial direction of said operating shaft, and a hollow cylindrical puffer piston for guiding a movement of said operating shaft, wherein the gas from said puffer chamber is compressed upon said separation of said contactors so as to blow said gas from said puffer chamber to said insulating nozzle and exhaust said gas through an exhaust passage passing through a hollow portion of said movable contactor, said exhaust passage is formed between said puffer chamber and said movable contactor, said exhaust gas guide is divided into a plurality of elements for closing an exhaust port during an initial stage of said separation and subsequently opening the exhaust port, said exhaust port being formed at an end of said exhaust passage located on a downstream side of the gas flow from said puffer chamber; and spring means provided on an exterior of said exhaust gas guide for urging said exhaust gas guide into contact with said cylinder.

2. A gas circuit breaker according to claim 1, wherein said exhaust gas guide is made of a metal material.

3. A gas circuit breaker according to claim 1, wherein said exhaust gas guide is made of an electrically insulating material.

4. A gas circuit breaker comprising:

an arc extinguishing gas;

a fixed contactor and a movable contactor separable from each other;

a nozzle of an electrically insulating material surrounding said contactors so as to guide a flow of the gas;

a cylinder forming a unitary body together with said movable contactor and said insulating nozzle, said cylinder having an operating shaft and forming a puffer chamber for compressing the gas therein upon a separation of said contactor;

a frame body comprising an exhaust gas guide gas-tightly fitted to said cylinder and having an opening therein, a cylindrical portion connected to the exhaust gas guide extending in an opposite direction to said fixed contactor along an axial direction of said operating shaft, and a hollow cylindrical puffer piston for guiding a movement of said operating shaft, wherein the gas from said puffer chamber is compressed upon said separation of said contactors so as to blow said gas from said puffer chamber to said insulating nozzle and exhaust said gas through an exhaust passage passing through a hollow portion of said movable contactor, said exhaust passage is formed between said puffer chamber and said movable contactor, said exhaust gas guide comprises an electrically insulating material on an exhaust port thereof for closing an exhaust port during an initial stage of said separation and subsequently opening the exhaust port, said exhaust port being formed at one end of said exhaust passage located on a downstream side of the gas flow from said puffer chamber; and spring means provided on an exterior of said exhaust gas guide for urging said exhaust gas guide into contact with said cylinder.

5. A gas circuit breaker comprising:

an arc extinguishing gas;

a fixed contactor and a movable contactor separable from each other;

a nozzle of an electrically insulating material surrounding said contactors so as to guide a flow of the gas;

a cylinder forming a unitary body together with said movable contactor and said insulating nozzle, said cylinder having an operating shaft and forming a puffer chamber for compressing the gas therein upon a separation of said contactors;

a frame body comprising an exhaust gas guide gas-tightly fitted to said cylinder and having an opening therein, a cylindrical portion connected to the exhaust gas guide extending in an opposite direction to said fixed contactor along an axial direction of said operating shaft, and a hollow cylindrical puffer piston for guiding the movement of said operating shaft, wherein the gas from said puffer chamber is compressed upon said separation of said contactor so as to blow said gas from said puffer chamber, said exhaust gas guide is divided into a plurality of elements for closing an exhaust port during an initial stage of said separation and subsequently opening the exhaust port, said exhaust port being formed at an end of said exhaust passage located on a downstream side of the gas flow from said puffer chamber, said exhaust passage is formed between said puffer chamber and said movable contactor;

spring means provided on an exterior of said exhaust gas guide for urging said exhaust gas guide into contact with said cylinder; and an electrically insulating material inserted between said exhaust gas guide and said cylindrical portion.

6. A gas circuit breaker comprising:

an arc extinguishing gas;

a fixed contactor and a movable contactor separable from each other;

a nozzle of an electrically insulating material surrounding said contactors so as to guide a flow of the gas;

a cylinder forming a unitary body together with said movable contactor and said insulating nozzle, said cylinder having an operating shaft and forming a puffer chamber for compressing the gas therein upon a separation of said contactors;

a frame body comprising an exhaust gas guide gas-tightly fitted to said cylinder, a cylindrical portion connected to the exhaust gas guide having an opening in a wall thereof and extending in an opposite direction to said fixed contactor along an axial direction of said operating shaft, and a hollow cylindrical puffer piston for guiding the movement of said operating shaft, wherein the gas from said puffer chamber is compressed upon said separation of said contactor so as to blow said gas from said puffer chamber to said insulating nozzle and exhaust said gas through an exhaust passage passing through a hollow portion of said movable contactor, said exhaust passage is formed between said puffer chamber and said movable contactor, said exhaust gas guide is made of an electrically insulating material and is divided into a plurality of elements for closing an exhaust port during an initial stage of said separation and subsequently opening the exhaust port, said exhaust port being formed at an end of said exhaust passage located on a downstream side of the gas flow from said puffer chamber, an inner diameter of said exhaust gas guide is equal to that of said cylindrical portion; and a spring means provided on an exterior of said exhaust gas guide for urging said exhaust gas guide into contact with said cylinder.

7. A gas circuit breaker comprising:

an arc extinguishing gas;

a fixed contactor and a movable contactor separable from each other;

a nozzle of an electrically insulating material surrounding said contactors so as to guide a flow of the gas;

a cylinder forming a unitary body together with said movable contactor and said insulating nozzle, said cylinder having an operating shaft and forming a puffer chamber for compressing the gas therein upon a separation of said contactors;

a frame body comprising an exhaust gas guide gas-tightly fitted to said cylinder, a cylindrical portion connected to the exhaust gas guide having an opening in a wall thereof and extending in an opposite direction to said fixed contactor along an axial direction of said operating shaft, and a hollow cylindrical puffer piston for guiding the movement of said operating shaft, wherein the gas from said puffer chamber is compressed upon said separation of said contactor so as to blow said gas from said puffer chamber to said insulating nozzle and exhaust said gas through an exhaust passage passing through a hollow portion of said movable contactor, said exhaust gas is formed between said puffer chamber and said movable contactor, said exhaust gas guide is made of an electrically insulating material and is divided into a plurality of elements for closing an exhaust port during an initial stage of said separation and subsequently opening the exhaust port, said exhaust port being formed at an end of said exhaust passage located on a downstream side of the gas flow from said puffer chamber, an inner diameter of said exhaust gas guide is larger than that of said cylindrical portion; and a spring means provided on said exhaust gas guide for urging said exhaust gas guide into contact with said cylinder.

* * * * *